US008208830B2

(12) United States Patent
Uratani et al.

(10) Patent No.: US 8,208,830 B2
(45) Date of Patent: Jun. 26, 2012

(54) PROCESS CARTRIDGE AND SPACE MAINTAINING MEMBER

(75) Inventors: Shunsuke Uratani, Mishima (JP); Shigemi Kamoshida, Susono (JP)

(73) Assignee: Canon Kabushiki Kaisha, Tokyo (JP)

( * ) Notice: Subject to any disclaimer, the term of this patent is extended or adjusted under 35 U.S.C. 154(b) by 1111 days.

(21) Appl. No.: 12/101,639

(22) Filed: Apr. 11, 2008

(65) Prior Publication Data

US 2008/0253800 A1 Oct. 16, 2008

(30) Foreign Application Priority Data

Apr. 13, 2007 (JP) ..... 2007-105689

(51) Int. Cl.
*G03G 21/16* (2006.01)
*G03G 21/18* (2006.01)

(52) U.S. Cl. ..... 399/111; 399/113

(58) Field of Classification Search ..... 399/111, 399/113, 114

See application file for complete search history.

(56) References Cited

U.S. PATENT DOCUMENTS

| | | | | |
|---|---|---|---|---|
| 6,947,686 | B2 | 9/2005 | Kawai et al. | 399/111 |
| 7,110,703 | B2 | 9/2006 | Uratani et al. | 399/254 |
| 7,283,765 | B2 | 10/2007 | Uratani et al. | 399/104 |

FOREIGN PATENT DOCUMENTS

| | | |
|---|---|---|
| JP | 5-297646 | 11/1993 |
| JP | 2003-241621 | 8/2003 |

*Primary Examiner* — David Gray
*Assistant Examiner* — Erika J Villaluna
(74) *Attorney, Agent, or Firm* — Fitzpatrick, Cella, Harper & Scinto

(57) ABSTRACT

A process cartridge is detachably mountable to a main assembly of an electrophotographic image forming apparatus. The process cartridge includes a photosensitive member unit having a photosensitive drum, a developer carrying member for developing an electrostatic latent image formed on the photosensitive drum with a developer, and a toner accommodating unit having a developer accommodating portion accommodating the developer to be used for development of the electrostatic latent image. A movable frame supports the developer carrying member, and an urging member is provided for urging the movable frame in a direction in which the developer carrying member approaches the photosensitive drum. A space maintaining member, is also provided for maintaining a state in which a distance between the photosensitive drum and the developer carrying member is larger than that in an image formation.

6 Claims, 9 Drawing Sheets

(a)

(b)

(a)

(b)

PROCESS CARTRIDGE AND SPACE MAINTAINING MEMBER

FIELD OF THE INVENTION AND RELATED ART

The present invention relates to a process cartridge used for electrophotographic image formation. More specifically, it relates to a gap maintaining member with which a process cartridge is fitted to ensure that a gap is maintained between its photosensitive member and developer bearing member (inclusive of spacer rings) during the distribution of the process cartridge.

In the following description of the present invention, the term "process cartridge" means a cartridge in which at least a developing means and an electrophotographic photosensitive member are integrally disposed so that they can be removably mounted in the main assembly of an electrophotographic image forming apparatus.

Further, the term "electrophotographic image forming apparatus" means an apparatus which forms an image on recording medium, with the use of an electrophotographic image forming method. Examples of an electrophotographic image forming apparatus are an electrophotographic printer (laser printer, LED printer, etc., for example), a facsimile apparatus, a wordprocessor, etc.

As the cumulative usage of a conventional electrophotographic image forming apparatus, that is, an electrophotographic image forming apparatus in accordance with the prior art, exceeds a certain length of time, various maintenance operations have to be performed, for example, the operation for replacing its electrophotographic photosensitive drum, the operation for replenishing the apparatus with developer or replacing the developer, the operation for adjusting, and/or cleaning the other components (charging device, cleaning device, etc.), etc. In the past, the operations, such as the abovementioned ones, for maintaining an electrophotographic image forming apparatus have been very difficult for an average user. As a matter of fact, they have been virtually impossible to perform, unless a person who performs the operations is a service person having professional knowledge of an image forming apparatus.

In the field of an electrophotographic image forming apparatus, therefore, a process cartridge system has come to be employed. According to a process cartridge system, an electrophotographic photosensitive member, and means for processing the electrophotographic photosensitive member, are integrally disposed in a cartridge so that they can be removably mounted in the main assembly of an electrophotographic image forming apparatus. Thus, a process cartridge system makes it possible for an average user to maintain an electrophotographic image forming apparatus by himself, that is, without relying on a service person. In other words, it drastically improves an electrophotographic image forming apparatus in operability. Thus, a process cartridge system has come to be widely used in the field of electrophotographic image forming apparatus.

There are two types of developing method compatible with an electrophotographic image forming apparatus which employs a process cartridge system, that is, the type which places an electrophotographic photosensitive member in contact with a developer bearing member, and the type which does not place an electrophotographic photosensitive member in contact with a developer bearing member. In the case of the latter, a latent image on an electrophotographic photosensitive member is developed by transferring developer onto the photosensitive drum from the developer bearing member, with roughly a preset amount of gap provided between the photosensitive member and developer bearing member by the gap regulating members placed in contact with the peripheral surface of the photosensitive member. In other words, in the case of an electrophotographic image forming apparatus which employs a process cartridge system, the developer bearing member is kept in contact with the electrophotographic photosensitive member by a pressure applying means, such as a spring, or the gap regulating member is kept in contact with the electrophotographic photosensitive member by the pressure applying means, such as a spring.

Thus, even during the distribution of a process cartridge, that is, even during the period between the moment a process cartridge has been completed to the moment the process cartridge is mounted into the main assembly of an image forming apparatus, the developer bearing member or gap regulating member is kept in contact with the electrophotographic photosensitive member by a pressure applying means, such as a spring. Therefore, the following problems sometimes occur during the distribution of a process cartridge.

That is, if a process cartridge happens to be subjected to a large amount of impact, the portion of the electrostatic photosensitive member, which is in contact with the developer bearing member or gap regulating member, the portion of the developer bearing member, which is in contact with the photosensitive member, and/or the portion of the gap regulating member, which is in contact with the photosensitive member, is also subjected to a large amount of impact, making it possible for the electrophotographic photosensitive member, developer bearing member, and/or gap regulating member to be damaged.

Next, some process cartridges which employ the prior arts for solving the above described problem will be described.

In the case of the process cartridge proposed in Japanese Laid-open Patent Application H05-297646, a protective means, which is a piece of film, is placed between the electrophotographic photosensitive member and developer bearing member, which are positioned to maintain a gap of 250 μm between them, as shown in FIG. 2 of the abovementioned application.

In the case of the process cartridge proposed in Japanese Laid-open Patent Application 2003-241621, the electrophotographic photosensitive member is supported by the first frame, whereas the developer bearing member is supported by the second frame, which is connected to the first frame so that it can be rotationally moved relative to the first frame, as shown in FIG. 10 of the abovementioned application. This process cartridge is characterized in that as soon as it is produced, it is fitted with a gap maintaining member which remains engaged with both the first and second frames to keep a greater distance between the axial line of the photosensitive member and the axial line of the developer bearing member during the distribution of the process cartridge than the distance maintained between the axial line of the photosensitive member and the axial line of the developer bearing member by the gap regulating member during image formation.

More specifically, in the case of the process cartridge proposed by Japanese Laid-open Patent Application H05-297646, a protective means, which is roughly 200-300 μm in thickness, is placed between the photosensitive member and developer bearing member, which are kept separated by roughly 200-300 μm by the gap regulating member. This structural arrangement, however, is effective only when the impact to which the process cartridge subjected is subjected is small. That is, it is effective to prevent the problem that the peripheral surface of the photosensitive member is damaged by the friction caused between the peripheral surface of the photosensitive member and developer bearing member by the direct contact between the peripheral surface of the photosensitive member and the peripheral surface of the developer bearing member. In other words, it is not effective to prevent the damages, more specifically, the deformation of the photosensitive member, developer bearing member, and/or gap regulating member, which occur as the process cartridge is subjected to a large amount of impact.

In the case of the process cartridge proposed by Japanese Laid-open Patent Application 2003-241621, the second frame, that is, the frame which supports the developer bearing member, has a developer storage. Thus, as the developer storage (developer container) is increased in capacity to prolong a process cartridge in service life, the second frame increases in weight, which in turn increases the amount of the contact pressure generated between the photosensitive member and developer bearing member during the distribution of the process cartridge, and also, the amount of impact to which the portion of the peripheral surface of the photosensitive member, which is in contact with the peripheral surface of the developer bearing member, or the gap regulating member, is subjected during the distribution of the process cartridge. In the case of this process cartridge, therefore, in order to prevent the deformation of the gap regulating member and/or the damage to the photosensitive member, the process cartridge must be increased in the distance between the photosensitive member and developer bearing member, or the distance between the photosensitive member and gap regulating member. The increase in the distance between the photosensitive member and developer bearing member, or the increase in the distance between the photosensitive member and gap regulating member, requires the process cartridge and/or gap maintaining member to be increased in size, and the increasing the process cartridge and/or gap maintaining in size adds to the cost of the process cartridge.

SUMMARY OF THE INVENTION

Thus, the primary object of the present invention is to provide a combination of a process cartridge, and a gap maintaining member which is no greater in size than a gap maintaining member in accordance with the prior art, which can prevent the problem that an electrophotographic photosensitive member, a developer bearing member, and/or a gap regulating member is damaged during the distribution of the process cartridge.

Another object of the present invention is to provide a combination of a process cartridge of a large capacity, and a gap maintaining member which is not greater in size than a gap maintaining member for a process cartridge of a small capacity.

Another object of the present invention is to provide a combination of a process cartridge, and a gap maintaining member which can keep the electrophotographic photosensitive member and developer bearing member separated regardless of the capacity of the developer storage portion of the process cartridge.

According to an aspect of the present invention, there is provided a process cartridge detachably mountable to a main assembly of an electrophotographic image forming apparatus, said process cartridge comprising a photosensitive member unit having a photosensitive drum; a developer carrying member for developing an electrostatic latent image formed on said photosensitive drum with a developer; a toner accommodating unit having a developer accommodating portion accommodating the developer to be used for development of said electrostatic latent image, said toner accommodating unit being fixed to said photosensitive member unit; a movable frame which is movable relative to said toner accommodating unit and which supports said developer carrying member; an urging member for urging said movable frame in a direction in which said developer carrying member approaches said photosensitive drum; and a space maintaining member, demountably provided between said photosensitive member unit and said movable frame in contact to said photosensitive member unit and said movable frame, for maintaining a state in which a distance between said photosensitive drum and said developer carrying member is larger than that in an image formation.

According to another aspect of the present invention, there is provided a space maintaining member detachably mountable to a process cartridge detachably mountable to a main assembly of an electrophotographic image forming apparatus, said process cartridge including a photosensitive member unit having a photosensitive drum; a developer carrying member for developing an electrostatic latent image formed on said photosensitive drum with a developer; a toner accommodating unit having a developer accommodating portion accommodating the developer to be used for development of said electrostatic latent image, said toner accommodating unit being fixed to said photosensitive member unit; a movable frame which is movable relative to said toner accommodating unit and which supports said developer carrying member; an urging member for urging said movable frame in a direction in which said developer carrying member approaches said photosensitive drum: wherein said space maintaining member, when said space maintaining member is mounted to said process cartridge, contacts to said photosensitive member unit and said movable frame to maintain a state in which a distance between said photosensitive drum and said developer carrying member is larger than that in an image formation.

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENTS

Hereinafter, the process cartridges and gap maintaining member, which are in accordance with the present invention, will be described in detail with reference to the appended drawings.

Embodiment 1

First, referring to FIGS. 1-9, the first embodiment of the present invention will be described.

Figure 1:
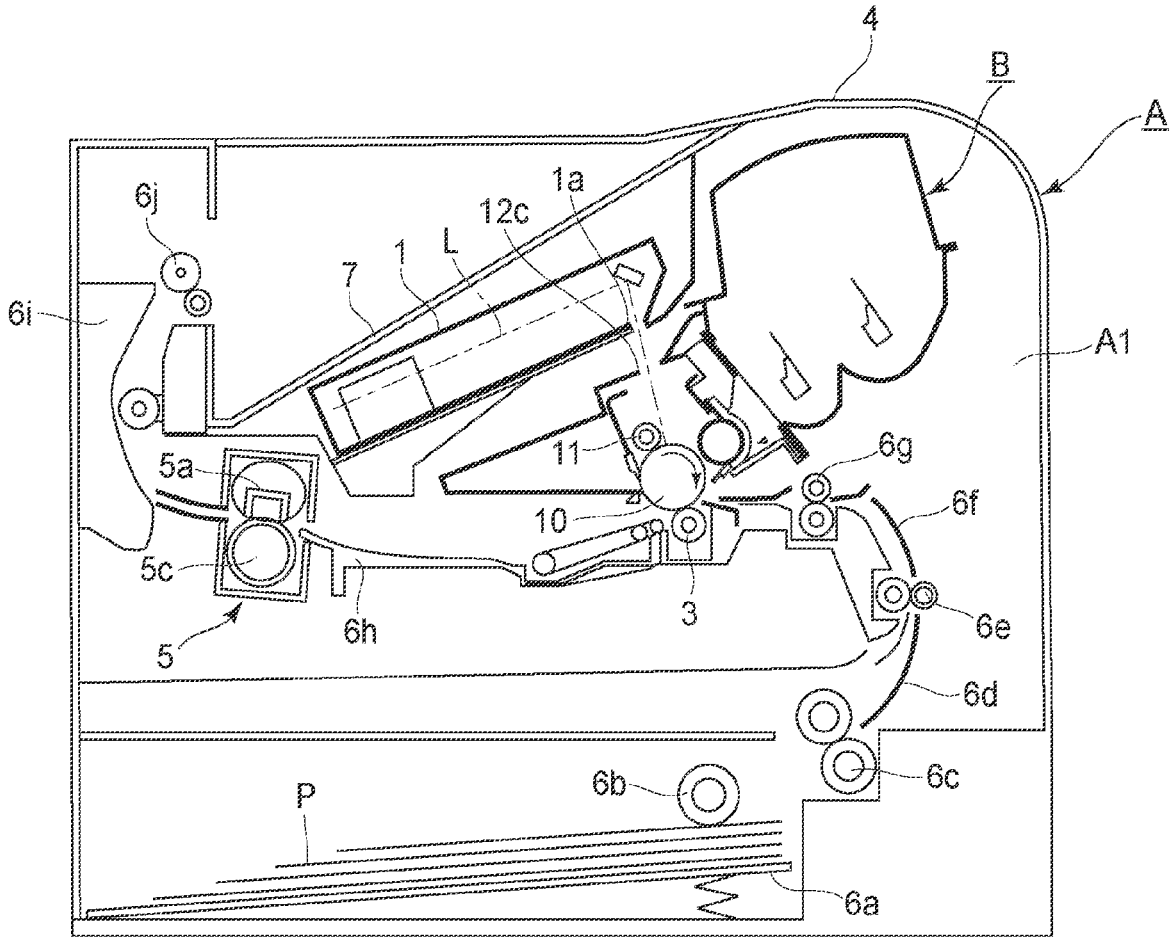
FIG. 1 is a schematic sectional view of a typical electrophotographic image forming apparatus which is compatible with a process cartridge in accordance with the present invention.
Figure 2:
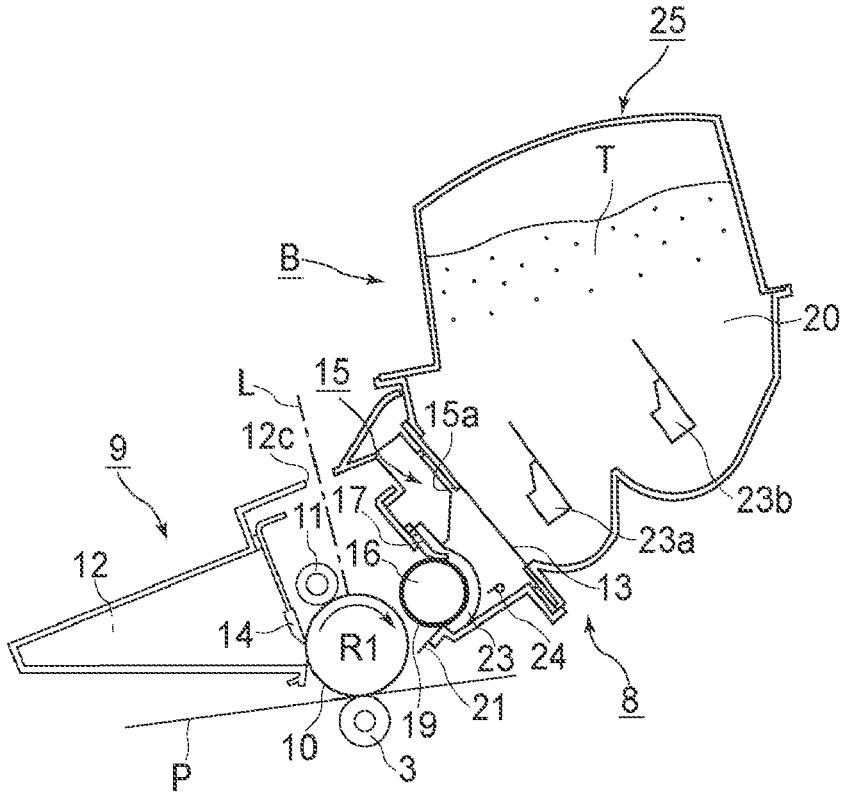
FIG. 2 is a schematic sectional view of a process cartridge in accordance with the present invention, showing the general structure of the cartridge.
Figure 3:
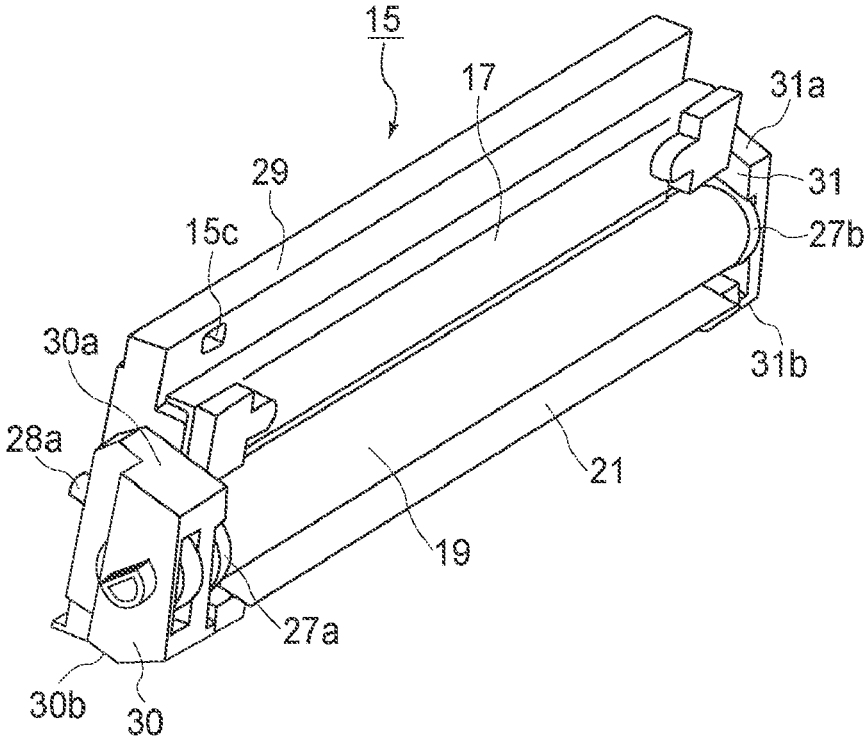
FIG. 3 is a perspective view of the developing means container unit of the process cartridge in accordance with the present invention, showing the structure of the container unit.
Figure 4:
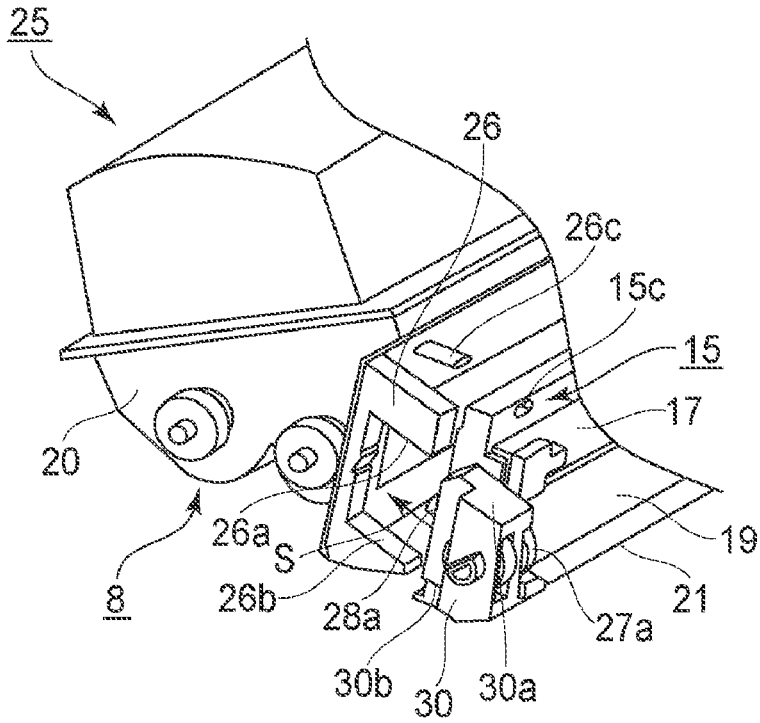
FIG. 4 is a perspective view of one of the lengthwise end portions of the process cartridge in accordance with the present invention, showing the structure of the developing means container unit.
Figure 4:
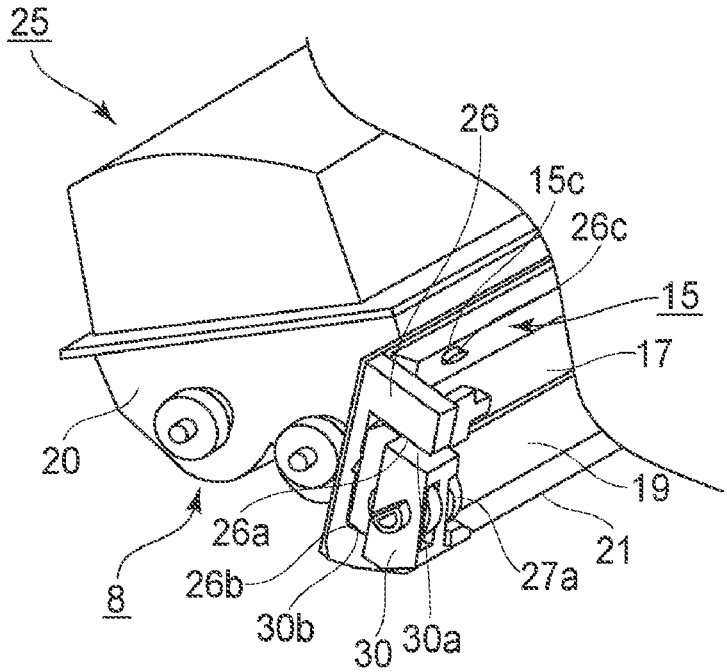
Figure 5:
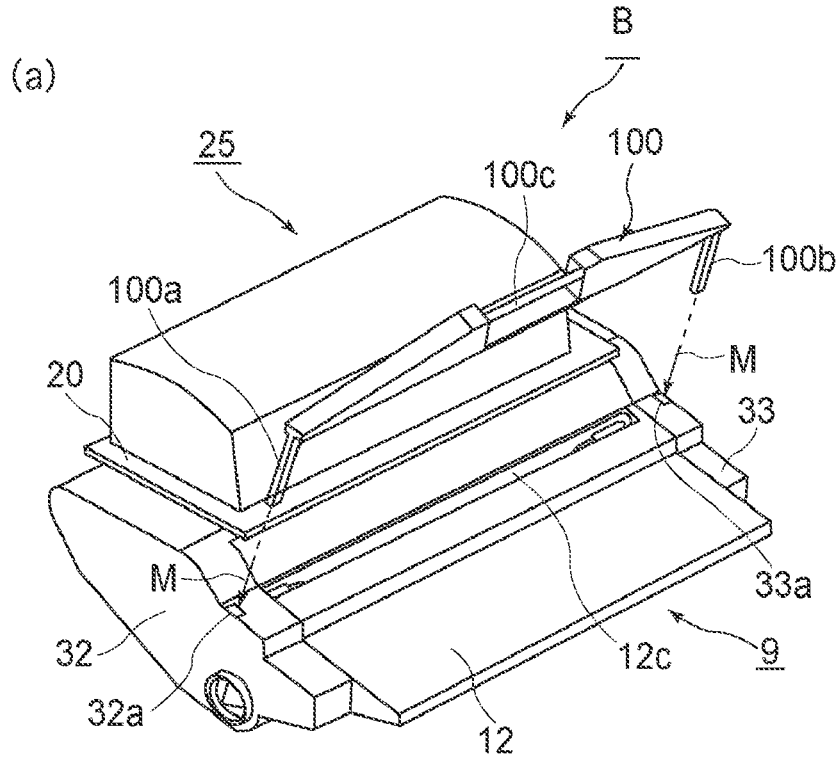
FIG. 5 is a perspective view of the combination of the process cartridge and gap maintaining member in the first embodiment of the present invention, showing the frame structure of the process cartridge, and how the gap maintaining member is engaged with the process cartridge.
Figure 5:
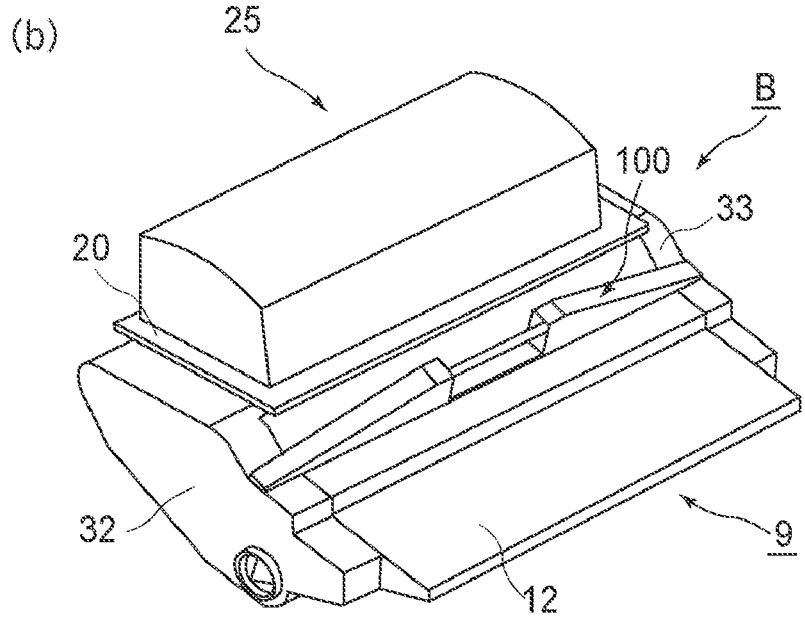
Figure 6:
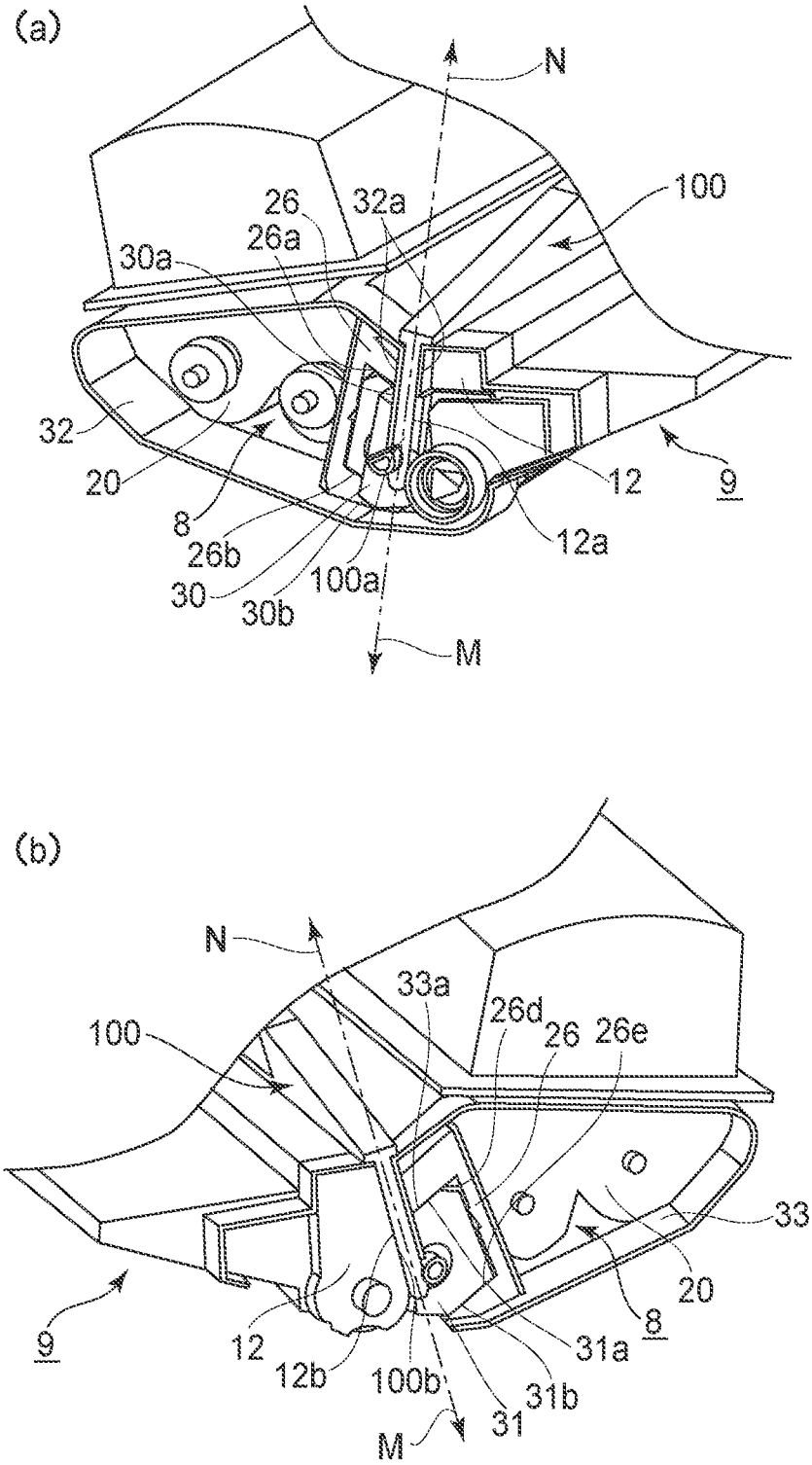
FIG. 6 is a perspective view of one of the lengthwise end portions of the process cartridge, and corresponding portion of the gap maintaining member, in the first embodiment of the present invention, showing how the gap maintaining member is engaged with the process cartridge to maintain a preset amount of gap between the photosensitive member and developer bearing member, and also, between the photosensitive member and gap regulating member, during the distribution of the process cartridge.
Figure 7:
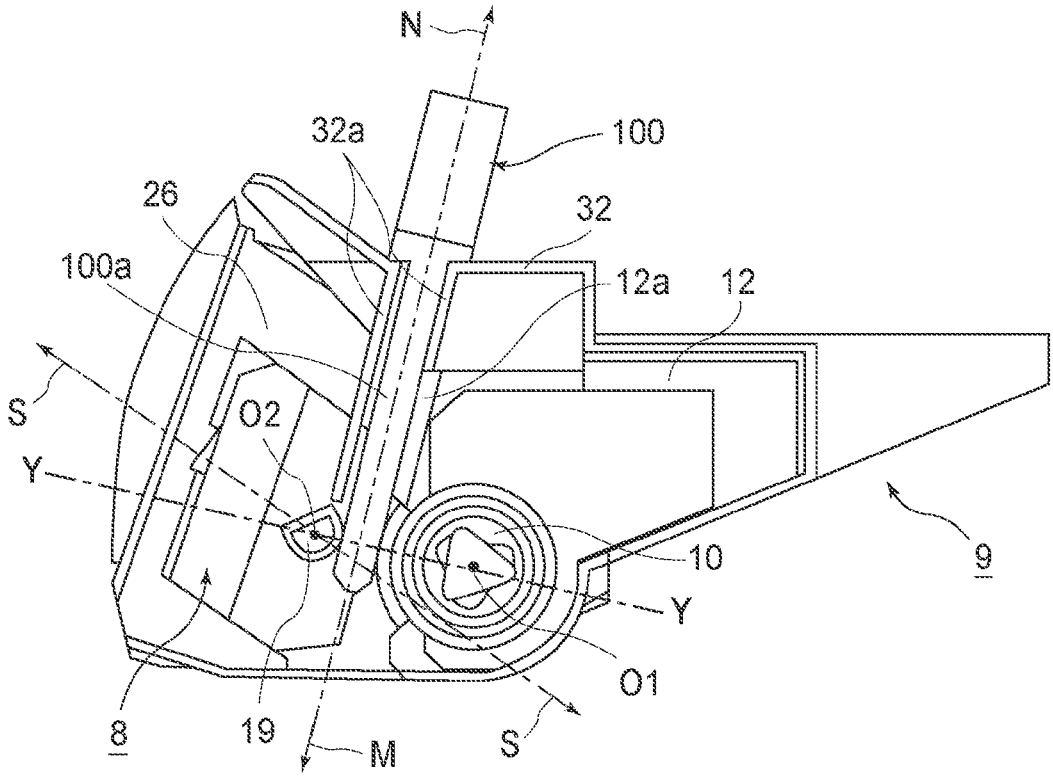
FIG. 7 is a plan view of one of the lengthwise ends of the process cartridge, and corresponding portion of the gap maintaining member, in the first embodiment of the present invention, showing how the gap maintaining member engages with the process cartridge to maintain a preset amount of gap between the photosensitive member and developer bearing member, and also, between the photosensitive member and gap regulating member, during the distribution of the process cartridge.
Figure 8:
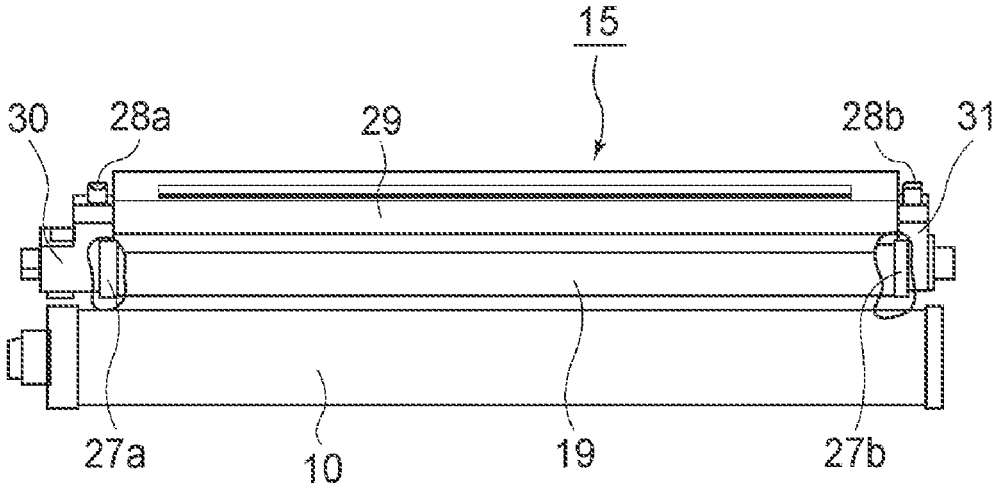
FIG. 8(*a*) is a plan view of the photosensitive member and developer bearing member, in the first embodiment of the present invention, which are not in their image forming positions because of the presence of the gap maintaining member, and FIG. 8(*b*) is a plan view of the photosensitive member and developer bearing member, in the first embodiment, which are in the image forming positions because of the absence of the gap maintaining member.
Figure 8:
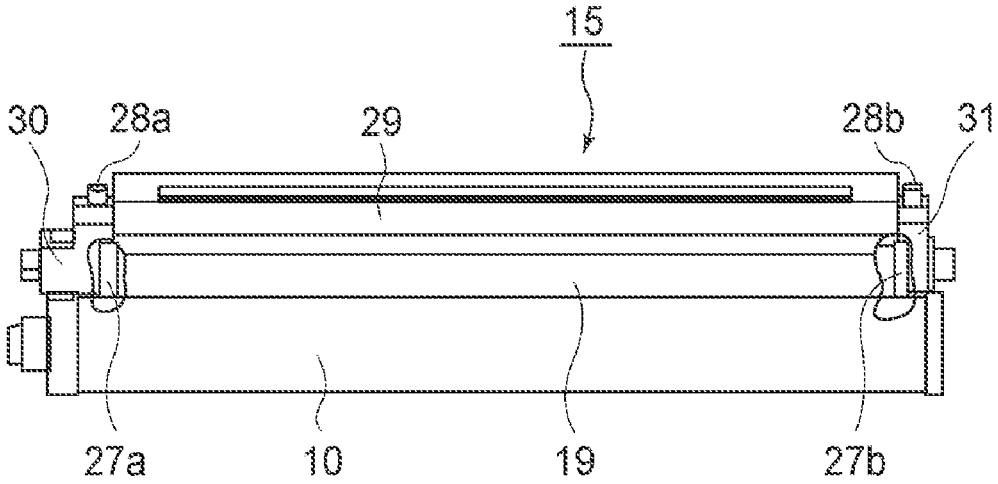
Figure 9:
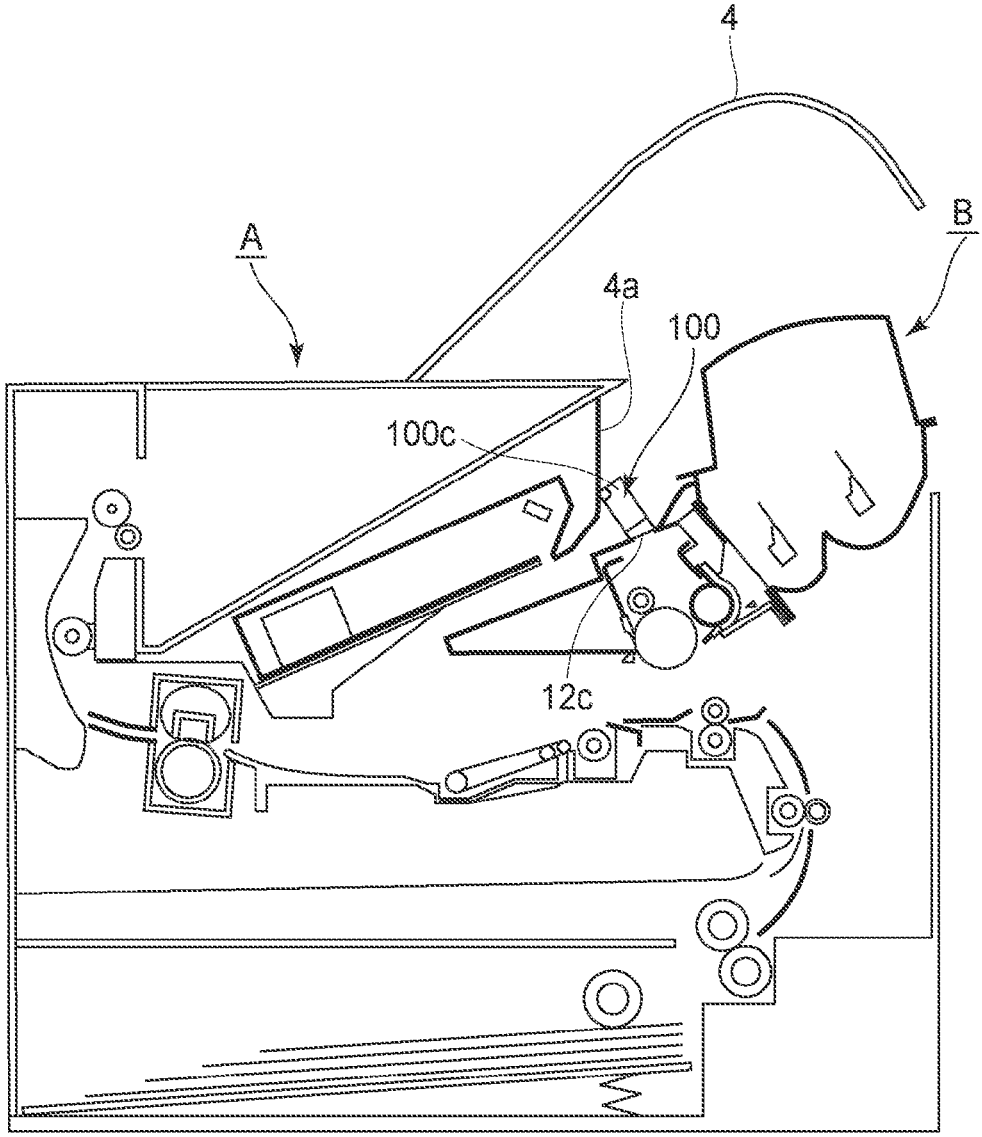
FIG. 9 is a schematic sectional view of a typical electrophotographic image forming apparatus which is compatible with a process cartridge in accordance with the present invention, showing what happens if the process cartridge in accordance with the present invention is mounted into the main assembly of the image forming apparatus without removing the gap maintaining member from the process cartridge.

FIG. 1 is a schematic sectional view of a typical electrophotographic image forming apparatus compatible with a process cartridge in accordance with the present invention. FIG. 2 is a schematic sectional view of a process cartridge in accordance with the present invention, and shows the general structure of the cartridge. FIG. 3 is a perspective view of the developing means container unit 15 of the process cartridge in accordance with the present invention, showing the structure of the container. FIGS. 4(*a*) and 4(*b*) are FIG. 4 are perspective views of one of the lengthwise end portions of the developing apparatus unit 8 of the process cartridge in accordance with the present invention, showing the structure of the developing apparatus unit 8. FIGS. 5(*a*) and 5(*b*) are perspective views of the combination of the process cartridge and gap maintaining member 100 in the first embodiment of the present invention, showing the frame structure of the process cartridge, and how the gap maintaining member 100 is engaged with the process cartridge. FIGS. 6(*a*) and 6(*b*) are perspective views of one of the lengthwise end portions of the process cartridge, and corresponding portion of the gap maintaining member 100, in the first embodiment of the present invention, showing how the gap maintaining member 100 is engaged with, or disengaged from, the process cartridge. FIG. 7 is a plan view of one of the lengthwise ends of the process cartridge, and corresponding portion of the gap maintaining member 100, showing how the gap maintaining member 100 is engaged with the process cartridge to maintain a preset amount of gap between the photosensitive member and developer bearing member, and also, between the photosensitive member and gap regulating member. FIG. 8(*a*) is a plan view of the photosensitive member and developer bearing member, which are not in the image forming positions because of the presence of the gap maintaining member 100, and FIG. 8(*b*) is a plan view of the photosensitive member and developer bearing member, which are in the image forming positions because of the absence of the gap maintaining member 100. FIG. 9 is a schematic sectional view of a typical electrophotographic image forming apparatus which is compatible with a process cartridge in accordance with the present invention, showing what happens if the process cartridge in accordance with the present invention is mounted into the main assembly of the image forming apparatus without removing the gap maintaining member 100 from the process cartridge.

In the following description of the preferred embodiments of the present invention, the term "widthwise direction" of a process cartridge B means the direction in which the process cartridge B is mounted into, or removed from, the main assembly A1 of an image forming apparatus 1. The widthwise direction of the process cartridge B coincides with the direction in which a recording medium P is conveyed. The term "lengthwise direction" of the process cartridge B means the direction perpendicular (roughly perpendicular) to the direction in which the process cartridge B is mounted into, or removed from, the apparatus main assembly A1. The lengthwise direction of the process cartridge B is parallel to the surface of the recording medium P, and is perpendicular to the direction in which the recording medium P is conveyed. Further, the referential symbols used in the description are only for designating the various components, portions, etc., of the image forming apparatus and process cartridge, which are shown in the drawings. They are not intended to limit the present invention in terms of the structures of an image forming apparatus and a process cartridge.

<General Structure of Electrophotographic Image Forming Apparatus>

Referring to FIG. 1, an electrophotographic image forming apparatus A in this embodiment is a laser printer. It is made up of its main assembly A1 and a process cartridge B. It has a cartridge cover 4, which is a part of the external shell of the laser printer A. Opening the cartridge cover 4 makes it possible for the cartridge B to be mounted into, or removed from the apparatus main assembly A1. The laser printer A forms an image on the recording medium P (recording paper, OHP sheet, fabric, etc.) using an electrophotographic image formation process, which uses developer (which hereafter will be referred to as toner). The electrophotographic image forming process is carried out by the process cartridge B.

More specifically, first, the peripheral surface of the electrophotographic photosensitive member 10 (which hereafter will be referred to as photosensitive drum) is uniformly charged by a charge roller 11, which is a charging means. Then, the uniformly charged peripheral surface of the photosensitive drum 10 is exposed to a beam of laser light L projected onto the peripheral surface of the photosensitive drum 10 from an exposing apparatus 1 (optical means) while being modulated with pictorial information. As a result, an electrostatic latent image, which reflects the pictorial information, is effected on the peripheral surface of the photosensitive drum 10. The latent image on the photosensitive drum 10 is developed by the developing means 8 into a toner image. The developing means 8 will be described later.

Meanwhile, the recording mediums P in the sheet feeder cassette 6*a* are sequentially fed into the apparatus main assembly A1 by the pickup roller 6*b*, a pair of recording medium conveying rollers 6*c* and 6*e*. Then, each recording medium P is conveyed to the nip between a transfer roller 3 (transferring means) and the photosensitive drum 10, by a pair of recording medium conveying-and-turning guides 6*d* and 6*f* and a pair of registration rollers 6*g*, in synchronism with the formation of the toner image. Thus, the conveyance of the recording medium P from the sheet feeder cassette 6*a* to the nip puts the recording medium P upside down.

Then, the recording medium P is conveyed through the nip formed between the photosensitive drum 10 and transfer roller 3 (transferring means), while a preset amount of voltage is applied to the transfer roller 3. As the recording medium P is conveyed through the nip, the toner image developed on the photosensitive drum 10 is transferred onto the recording medium P.

After the transfer of the toner image onto the recording medium P, the recording medium P is guided to the fixing means 5 by a recording medium conveyance guide 6*h*. The fixing means 5 is made up of a driver roller 5*c* and a heater 5*a*. The driving roller 5*c* also functions as a pressure applying means. While the recording medium P is conveyed through the fixing means 5, the fixing means 6 applies heat and pressure to the recording medium P and the toner image thereon. As a result, the toner image is fixed to the recording medium P.

Thereafter, the recording medium P is conveyed further by a recording medium conveyance guide 6*i*, and then, is discharged into a delivery tray 7 by a pair of discharge rollers 6*j*, with the image bearing surface facing downward.

<Process Cartridge>

The process cartridge B is made up of the photosensitive drum 10, means for processing the photosensitive drum 10, and a cartridge in which the photosensitive drum 10 and processing means are integrally disposed. The processing means are a charging means for charging the peripheral surface of the photosensitive drum 10, a developing means for developing an electrostatic latent image formed on the peripheral surface of the photosensitive drum 10, and a cleaning means for removing the toner remaining on the peripheral surface of the photosensitive drum 10. The process cartridge B is required to have the photosensitive drum 10 and at least one of the processing means.

Referring to FIG. 2, in this embodiment, the process cartridge B is made up a photosensitive member unit 9 and a developing apparatus unit 8 (developing means).

The photosensitive member unit 9 of the process cartridge B has a first frame portion 12 (which hereafter will be referred to as waste toner container), the photosensitive drum 10, and the charge roller 11. The photosensitive drum 10 is for forming an electrostatic latent image. The charge roller 11 is for uniformly charging the peripheral surface of the photosensitive drum 10. The photosensitive drum unit 9 also has a cleaning blade 14, which scrapes the peripheral surface of the photosensitive drum 10 to remove from the peripheral surface, the residual toner T, that is, the toner remaining adhered to the peripheral surface of the photosensitive drum 10 without being transferred onto the recording medium P. The removed residual toner T collects in the waste toner container 12.

The developing apparatus unit 8 of the process cartridge B is a developing means, as described above. It has a toner storage unit 25, a development blade 17, a developer bearing member 19 (which hereafter will be referred to as development sleeve), and a developing means container unit 15, etc. There is a magnetic roller 16 (magnetic field generating means) in the hollow of the development sleeve 19.

The toner storage unit 25 has a developer storage portion 20 (which hereafter will be referred to as toner storage container), and a second frame portion 26 (which hereafter will be referred to as guiding frame) (FIG. 4(*a*)). The toner storage container 20 stores the toner T. It is solidly connected to the guiding frame 26.

There is a toner seal 13 between the toner storage container 20 and guiding frame 26. The toner seal 13 prevents the unused toner T from leaking from the toner storage container 20. Pulling out the toner seal 13 allows the toner T in the toner storage container 20 to flow into the developing means container unit 15.

In this embodiment, the toner storage container 20 and the guiding frame 26, which make up the toner storage container unit 25 by being solidly attached to each other, are independently formed. However, they may be integrally formed.

(Image Formation Process)

The developing apparatus unit 8 (developing means) sends the toner T in the toner storage container 20 to the development sleeve 19 through the opening 15*a* of the developing means container unit 15*a*, by rotating a pair of stirring means 23*a* and 23*b*. It has a developer stirring member 24 for circulating the toner T in the developing means container unit 15. The developer stirring member 24 is rotatably disposed in the adjacencies of the development sleeve 19. The developing apparatus unit 8 also has a blowout prevention seal 21 for keeping sealed the gap between the development sleeve 19 and the bottom portion of the developing means container unit 15. That is, the blowout prevention seal 21 prevents the toner T from leaking downward relative to the position of the development sleeve 19.

The developing apparatus unit 8 has a pair of magnetic seals 22, which are located at the lengthwise ends of the development sleeve 19, one for one, with the provision of a preset amount of gap between the peripheral surface of the development sleeve 19 and the magnetic seal 22. The magnetic seal 22 prevents the toner T from leaking from the developing apparatus unit 8 through the gap between the lengthwise end of the development sleeve 19 and the developing means container unit 15. More specifically, the magnetic seal 22 forms a magnetic field between itself and the magnetic roller 16 to form a brush of the toner T, in the abovementioned gap to prevent the toner T from leaking.

As described above, the toner T is sent to the development sleeve 19, which is rotating, with the presence of the stationary magnetic roller 16 supported in the hollow of the development sleeve 19. Thus, the toner T is borne on the peripheral surface of the development sleeve 19, and is formed into a uniform layer of toner with a preset thickness, by the development blade 17, while being frictionally charged by the development sleeve 19 and development blade 17.

The lengthwise end portions of the development sleeve 19 are fitted with a pair of gap maintaining members 27*a* and 27*b* (which hereafter will be referred to as spacer ring), one for one (FIG. 3). The spacer rings are roughly coaxial and are larger in radius than the development sleeve 19, by the amount equal to the preset amount of clearance which the spacer rings are required to provide between the peripheral surface of the photosensitive drum 10 and the peripheral surface of the development sleeve 19. The spacer rings 27*a* and 27*b* are kept pressed upon the peripheral surface of the photosensitive drum 10 by a pair of pressure generating members 28*a* and 28*b* (which hereafter will be referred to simply as spring) (FIG. 8). With the presence of the spacer rings 27*a* and 27*b* between the peripheral surface of the development sleeve 19 and the peripheral surface of the photosensitive drum 10, and also, the presence of the pressure from the springs 28*a* and 28*b*, the preset amount of clearance is maintained between the peripheral surface of the development sleeve 19 and the peripheral surface of the photosensitive drum 10.

The toner layer formed on the peripheral surface of the development sleeve 19 is moved by the rotational of the development sleeve 19 into the development area, in which the toner in the toner layer is transferred onto the peripheral surface of the photosensitive drum 10 in a manner to reversely reflect the electrostatic latent image on the peripheral surface of the photosensitive drum 10. As a result, an image is formed of toner, on the peripheral surface of the photosensitive drum 10.

The photosensitive drum 10 is rotated in the direction indicated by an arrow mark R1, while a preset amount of voltage is being applied to the charge roller 11 which is in contact with the peripheral surface of the photosensitive drum 10. As a result, the portion of the photosensitive layer of the photosensitive drum 10, which is in contact with the charge roller 11, is uniformly charged. Then, the uniformly charged portion of the peripheral surface of the photosensitive drum 10 is exposed to a beam of laser light L projected onto the photosensitive drum 10 while being modulated with pictorial information. As a result, an electrostatic latent image is effected on the peripheral surface of the photosensitive drum 10. Thereafter, the electrostatic latent image is developed into a toner image by the developing means.

The toner image formed on the peripheral surface of the photosensitive drum 10 is transferred onto the recording medium by applying such voltage that is opposite in polarity to the abovementioned toner image, to the transfer roller 3, with which the laser printer A is provided. Thereafter, the residual toner T, that is, the toner T remaining on the peripheral surface of the photosensitive drum 10 after the toner image transfer, is removed by the cleaning blade 14. More specifically, the cleaning blade 14 is placed in contact with the peripheral surface of the photosensitive drum 10 to scrape the peripheral surface of the photosensitive drum 10 to remove the residual toner T on the photosensitive drum 10. After being removed from the peripheral surface of the photosensitive drum 10 by the cleaning blade 14, the residual toner T collects in the waste toner container 12.

(Frame Structure of Process Cartridge)

Referring to FIG. 3, the developing means container unit 15 is made up of a slide frame 29, a right side frame 30, and a left slide frame 31. The right and left slide frames 30 and 31 are integrally attached to the slide frame 29. The development sleeve 19 is rotatably supported by the right and left slide frames 30 and 31, with the positioning of a pair of sleeve bearings (unshown) between the lengthwise ends of the development sleeve 19 and the right and left slide frame 30 and 31, respectively. The development blade 17 is solidly attached to the slide frame 29.

Referring to FIGS. 3, 4(*a*), and 4(*b*), the top and bottom surfaces 30*a* and 30*b* of the right slide frame 30 of the developing means container unit 15 are parallel to each other, and control the direction in which the developing means container unit 15 slides (direction indicated by arrow mark S in FIG. 4(*a*)). Next, referring to FIG. 4(*b*), the guiding frame 26 has a pair of guiding surfaces 26*a* and 26*b*, which oppose the slide surfaces 30*a* and 30*b*, respectively, when the developing means container unit 15 remains properly engaged in the guiding frame 26. There is a spring 28*a* (pressure generating member) between the developing means container unit 15 and guiding frame 26. Thus, the developing means container unit 15 is kept pressed toward the photosensitive member unit 9. That is, the spring 28*a* presses the developing means container unit 15 in the direction to keep the development sleeve 19 virtually in contact with, or truly in contact with the photosensitive drum 10. The slide surfaces 31*a* and 31*b* of the left slide frame 31, and the guiding surfaces 26*d* and 26*e* of the guiding frame 26 (which opposes slide surfaces 31*a* and 31*b*, respectively), and a spring 28*b*, are the same in structure and positioning as those of the right slide frames 31 and right guiding frame 26, and the spring 28*a* (FIG. 6(*b*)).

Further, the developing means container unit 15 is provided with a hole 15*c*, which is rectangular in cross section, whereas the guiding frame 26 is provided with a boss 26*c* (FIGS. 4(*a*) and 4(*b*)). The hole 15*c* and boss 26*c* are for accurately positioning the developing means container unit 15 and guiding frame 26 relative to each other in terms of their lengthwise direction.

Since the developing means container unit 15 and guiding frame 26 are structured as described above, the developing means container unit 15 slides straight in the widthwise direction (indicated by arrow mark S in FIG. 4(*a*)), relative to the guiding frame 26.

Referring to FIG. 5(*a*), the photosensitive member unit 9, and the toner storage unit 25 of the developing apparatus unit 8 are kept solidly attached to each other, by first and second side covers 32 and 33, which are located at one lengthwise end of the process cartridge B and the other, respectively. Hereafter, the first side cover 32 will be referred to as the right side cover, whereas the second side cover will be referred to as the left side cover.

Since the process cartridge B is structured as described above, the developing means container unit 15 is allowed to slide straight in the direction indicated by the arrow mark S in FIG. 4(*a*), relative to the toner storage unit 25. As the developing means container unit 15 is moved toward the toner storage unit 25 as described above, the spacer rings 27*a* and 27*b*, with which the lengthwise end portions of the development sleeve 19 supported by the developing means container unit 15 are fitted, one for one, are placed in contact with the peripheral surface of the photosensitive drum 10 supported by the photosensitive member unit 9. As a result, the developing means container unit 15 becomes fixed in position in terms of its widthwise direction. Therefore, the development sleeve 19 is pressed toward the photosensitive drum 10, with the presence of the spacer rings 27*a* and 27*b* between the development sleeve 19 and photosensitive drum 10, while the developing means container unit 15 and toner storage container 20 remain in the state in which the weight of the toner T in the toner storage container 20 is likely to rest on the developing means container unit 15.

<Gap Maintaining Means>

In this embodiment, the process cartridge B is provided with a gap maintaining means, that is, a means for keeping the distance between the axial line of the photosensitive drum 10 and the axial line of the development sleeve 19 greater when the process cartridge B is distributed than when the process cartridge 5 is being used for image formation, that is, a means for keeping the spacer rings 27*a* and 27*b*, with which the lengthwise ends of the development sleeve 19 are fitted one for one, separated from the photosensitive drum 10 during the distribution of the process cartridge B.

Referring to FIG. 5(*a*), the gap maintaining means in this embodiment is a gap maintaining member 100, which has a pair of gap maintaining portions 100*a* and 100*b*, and a handgrip portion 100*c* which is gripped by a user to take hold of the gap maintaining member 100. The gap maintaining member 100 is removably attachable to the process cartridge B. The gap maintaining member 100 is shaped (FIG. 5(*b*)) to cover the exposure window 12*c*, with which the waste toner container 12 is provided to allow the beam of laser light L to be projected onto the peripheral surface of the photosensitive drum 10 while being modulated with pictorial information. The process cartridge B may be structured so that the exposure window 12*c* is provided between the waste toner container 12 and guiding frame 26.

The handgrip portion 100*c* of the gap maintaining member 100 is on the opposite side of the gap maintaining member 100 from the portion of the gap maintaining member 100, which is for covering the exposure window 12*c*. Next, referring to FIG. 5(*b*), the gap maintaining member 100 is shaped so that when the gap maintaining member 100 remains attached to the process cartridge B, the handgrip portion 100*c* extends from the process cartridge B by a substantial distance beyond the top surface of the waste toner container 12.

Next, referring to FIGS. 6(*a*) and 6(*b*), in this embodiment, the waste toner container 12 is provided with a pair of contact surfaces 12*a* and 12*b*, which come into contact with the gap maintaining portions 100*a* and 100*b* of the gap maintaining member 100, respectively. The waste toner container 12 is structured so that when the gap maintaining member 100 remains attached to the process cartridge B, the contact surfaces 12*a* and 12*b* are perpendicular to the straight line connecting the axial line O1 of the photosensitive drum 10 and the axial line O2 of the development sleeve 19 (Line Y-Y in FIG. 7).

The gap maintaining means is a the means for keeping the distance between the axial line of the photosensitive drum 10 and the axial line of the development sleeve 19 greater when it remains attached to the process cartridge B than when the process cartridge B is being used for image formation, and also, for keeping the spacer rings 27*a* and 27*b*, with which the lengthwise ends of the development sleeve 19 are fitted one for one, separated from the photosensitive drum 10 when it remains attached to the process cartridge B. It works in the following manner.

That is, the gap maintaining member 100 is to be positioned, as shown in FIG. 5(*a*), relative to the process cartridge B, and then, is to be moved in the direction indicated by an arrow mark M in FIG. 5 so that its gap maintaining portions 100*a* and 100*b* follow a pair of gap maintain member insertion guides 32*a* and 32*b*, with which the right and left side covers 32 and 33 are provided, respectively. In other words, the gap maintaining member 100 is to be positioned, as shown in FIG. 5(*a*), relative to the process cartridge B, and then, is to be moved in the direction indicated by the arrow mark M in FIG. 5 so that its gap maintaining portions 100*a* and 100*b* enter the gaps between the contact surfaces 12*a* and 12*b* of the waste toner container 12, and the right and left side frames 30 and 31 of the developing means container unit 15, respectively. Then, the gap maintaining member 100 is to be pressed further inward of the process cartridge B so that the developing means container unit 15 is separated from the waste toner container 12 against the resiliency of the springs 28*a* and 28*b* (FIG. 8(*a*)).

The direction in which the developing means container unit 15 is slid as the gap maintaining member 100 is pressed further into the process cartridge B is the direction indicated by an arrow mark S in FIG. 7. The direction in which the gap maintaining member 100 is pressed into the process cartridge B, or pulled out of the process cartridge B, is the direction indicated by an arrow mark M or N, respectively, in FIG. 7. The relationship between the developing means container unit 15 slides and the direction in which the gap maintaining member 100 is pressed into, or removed from, the process cartridge B, is such that the weight of the developing means container unit 15 and the resiliency of the springs 28*a* and 28*b* press the gap maintaining member 100 on the contact surfaces 12*a* and 12*b*. Therefore, the gap maintaining member 100 is secured between the contact surfaces 12*a* and 12*b* of the waste toner container 12 and the developing means container unit 15, by the weight of the developing means container unit 15 and the force generated by the resiliency of the springs 28*a* and 28*b*.

The gap maintaining portions 100*a* and 100*b* of the gap maintaining member 100 are subjected to the force generated by the resiliency of the springs 28*a* and 28*b* through the developing means container unit 15. They are also indirectly subjected, through the developing means container unit 15, to the impact to which the process cartridge B is subjected during the distribution of the process cartridge B.

Therefore, the width and thickness of the gap maintaining portions 100*a* and 100*b* of the gap maintaining member 100 are set to ensure that when the gap maintaining member 100 remains properly attached to the process cartridge B, the distance between the axial line of the photosensitive drum 10 and the axial line of the development sleeve 19 remains greater than when the process cartridge B is being used for image formation, or to ensure that when the gap maintaining member 100 remains properly attached to the process cartridge B, the spacer rings 27*a* and 27*b*, with which the lengthwise ends of the development sleeve 19 are fitted one for one, remain separated from the photosensitive drum 10, even if the process cartridge B is subjected to a substantial amount of impact during the distribution of the process cartridge B.

The gap maintaining member 100 has to be removed from the process cartridge B before the process cartridge B is mounted into the laser printer A. The gap maintaining member 100 can be removed by pulling it by gripping the handgrip portion of the gap maintaining member 100 (direction in which gap maintaining member 100 is to be moved is indicated by arrow mark N in FIG. 7). As the gap maintaining member 100 is pulled out in the abovementioned direction, the developing means container unit 15 is slid straight toward the photosensitive member unit 9 by the force generated by the resiliency of the springs 28*a* and 28*b*. As a result, the spacer rings 27*a* and 27*b*, with which the lengthwise end portions of the development sleeve 19 are fitted, are pressed upon the peripheral surface of the photosensitive drum 10 (FIG. 8(*b*)). At the same time, the exposure windows 12*c* becomes exposed, allowing the beam of laser light L projected while being modulated with the pictorial information, to reach the peripheral surface of the photosensitive drum 10. It is only when the process cartridge B is in the above described condition that the process cartridge B can be mounted into the laser printer A.

In the case of a process cartridge, such as the process cartridge B, structured as described above, the weight of the toner T in the toner storage container 20 is unlikely to rest on the developing means container unit 15. Therefore, in practical terms, it is only the developing means container unit 15 itself that affects the gap maintaining portions 100*a* and 100*b* of the gap maintaining member 100.

Therefore, in the case of a process cartridge structured as described above, the effect which the weight of the toner T in the toner storage container 20 has on the gap maintaining portions 100*a* and 100*b* of the gap maintaining member 100 when the process cartridge B is subjected to impact during the distribution of the process cartridge B, is significantly smaller than in the case of a process cartridge structured in accordance with the prior art.

Further, the gap maintaining means in this embodiment is also very effectively usable with a process cartridge of a large capacity. That is, even when the gap maintaining member 100 is produced for a process cartridge of a large capacity, the width and thickness of the gap maintaining portions 100*a* and 100*b* of the gap maintaining member 100 may be the same as those when the gap maintaining member 100 is produced for a process cartridge of a small capacity. In other words, the gap maintaining means in this embodiment can be used even with a process cartridge of a large capacity to ensure that when the gap maintaining member 100 remains properly attached to the process cartridge B, the distance between the axial line of the photosensitive drum 10 and the axial line of the development sleeve 19 remains greater than when the process cartridge B is being used for image formation, or to ensure that when the gap maintaining member 100 remains properly attached to the process cartridge B, the spacer rings 27*a* and 27*b*, with which the lengthwise ends of the development sleeve 19 are fitted one for one, remain separated from the photosensitive drum 10. In other words, regardless of process cartridge capacity, the gap maintaining means in this embodiment can prevent the problem that the photosensitive drum 10, development sleeve 19, and/or spacer rings 27*a* and 27*b* are damaged during the distribution of the process cartridge B.

The force to which the gap maintaining portions 100*a* and 100*b* of the gap maintaining member 100 are subjected when the gap maintaining member 100 is disengaged from the process cartridge B is only the force generated by the resiliency of the springs 28*a* and 28*b*, and the weight of the developing means container unit 15. Therefore, the amount of force necessary to disengage the gap maintaining member 100 from the process cartridge B is significantly smaller than that required to disengage a gap maintaining member (100) in accordance with the prior art from a process cartridge (B) in accordance with the prior art.

Further, while the gap maintaining member 100 remains properly engaged with the process cartridge B, the exposure window 12*c* remains covered with the gap maintaining member 100. Therefore, until the gap maintaining member 100 is disengaged from the process cartridge B (inclusive of while process cartridge B is distributed), the dust and light have no chance to enter the process cartridge B, being thereby prevented from derogatorily affecting the photosensitive drum 10.

Further, unless the gap maintaining member 100 is completely disengaged from the process cartridge B, the process cartridge B cannot be mounted into the laser printer A. More specifically, referring to FIG. 9, if an attempt is made to mount the process cartridge B into the laser printer A without removing the gap maintaining member 100, the handgrip portion 100*c* of the gap maintaining member 100, which protrudes in the opposite direction from the exposure window 12*c*, comes into contact with the internal cover 4*a* of the laser printer A, and prevents the process cartridge B from being inserted further into the laser printer A. In other words, the handgrip portion 100*c* of the gap maintaining member 100 reminds a user that the user forgot to remove the gap maintaining member 100 from the process cartridge B, preventing thereby the user from improperly mounting the process cartridge B into the laser printer A.

Incidentally, in this embodiment of the present invention, the process cartridge B and gap maintaining member 100 were structured so that the gap maintaining portions 100*a* and 100*b* of the gap maintaining member 100 come into contact with the contact surfaces 12*a* and 12*b* of the waste toner container 12. However, the process cartridge B and gap maintaining member 100 may be structured so that the right and left side cover 32 and 33 are provided with the contact surfaces, with which the gap maintaining portions 100*a* and 100*b* of the gap maintaining member 100 come into contact, respectively. The effect of such structural arrangement is the same as that of this embodiment, that is, the structural arrangement which uses the contact surfaces 12*a* and 12*b* of the waste toner container 12 as the surfaces with which the gap maintaining portions 100*a* and 100*b* of the gap maintaining member 100 come into contact.

Also in this embodiment of the present invention, the process cartridge B and gap maintaining member 100 were structured so that as the gap maintaining member 100 is engaged with the process cartridge B, the gap maintaining portions 100*a* and 100*b* of the gap maintaining member 100 come into, and remain in, contact with a part of the right frame 30 of the developing means container unit 15, and a part of the left frame 31, respectively. However, the process cartridge B and gap maintaining member 100 may be modified in structure so that the slide frame 29 functions as the portion of the process cartridge B, with which the gap maintaining portions 100*a* and 100*b* of the gap maintaining member 100 come into contact, and remain in contact. Also in this case, the gap maintaining member 100 can function as the gap maintaining means just as effectively as in the case in which the process cartridge B and gap maintaining member 100 are structured so that the gap maintaining portions 100*a* and 100*b* of the gap maintaining member 100 come into contact, and remain in contact, with the right and left slide frames 30 and 31, respectively.

Embodiment 2

Figure 10:
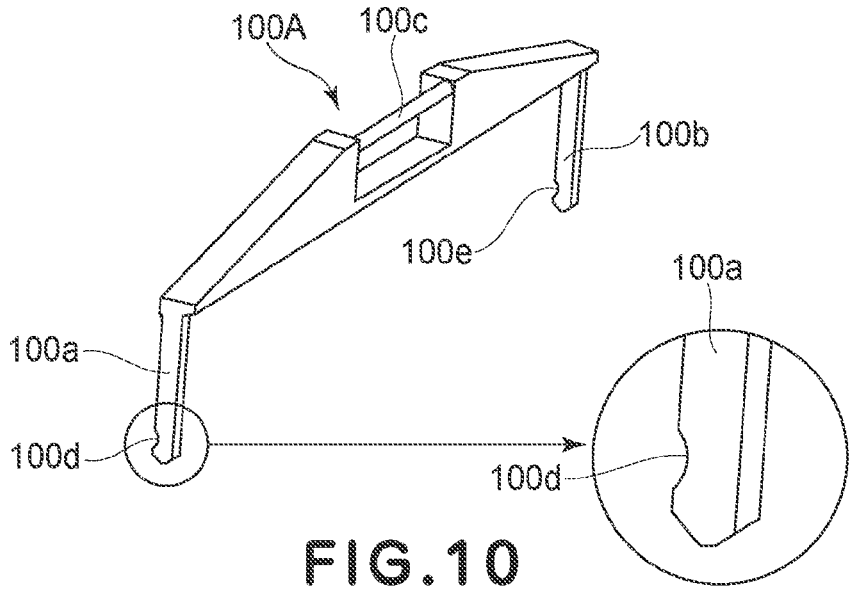
FIG. 10 is a perspective view of the gap maintaining member in the second embodiment of the present invention.
Figure 11:
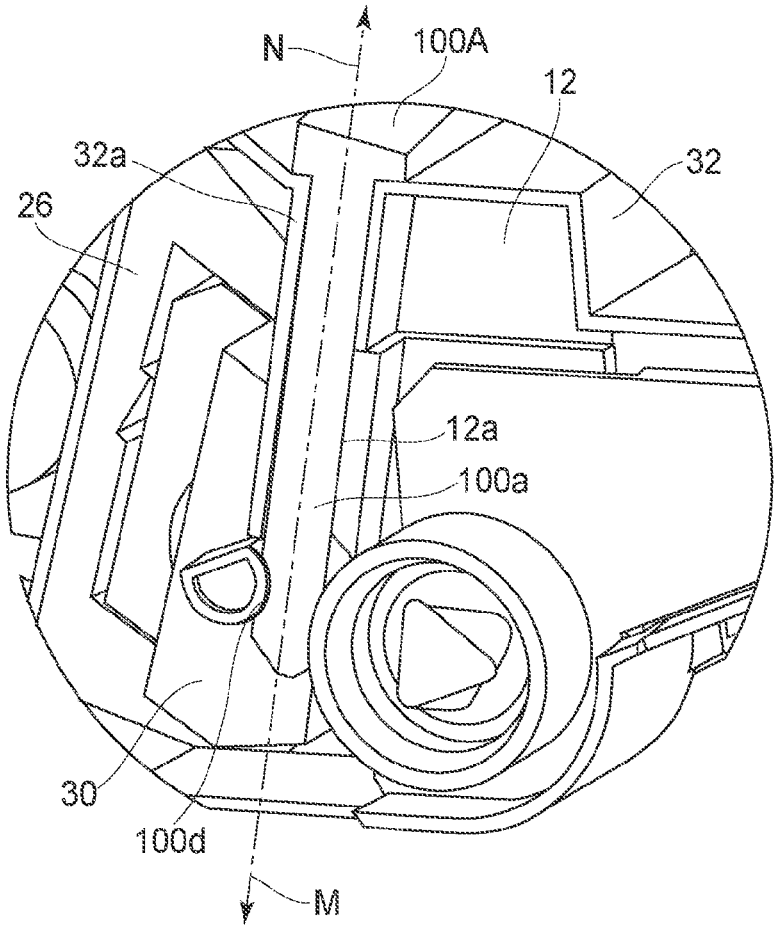
FIG. 11 is a perspective view of the combination of one of the lengthwise end portions of the process cartridge, and the corresponding portion of the gap maintaining member properly engaged with the process cartridge, in the second embodiment of the present invention.

Next, referring to FIGS. 10 and 11, the second embodiment of the present invention will be described. FIG. 10 is a schematic perspective view of the gap maintaining member in this embodiment, and depicts the structure of the gap maintaining member. FIG. 11 is a perspective view of the lengthwise end portion of the process cartridge when the gap maintaining member in this embodiment is properly engaged with the process cartridge in this embodiment.

The gap maintaining member 100A, that is, the gap maintaining member in this embodiment, is the same in structure as the gap maintaining member 100, that is, the gap maintaining member in the first embodiment. Thus, the portions of the gap maintaining member 100A, which are the same in structure and function as the counterparts of the gap maintaining member 100, are given the same referential symbols as those given to the counterparts, so that the description of the counterparts of the gap maintaining member 100 can be employed to avoid the repetition of the same description.

Referring to FIG. 10, the gap maintaining portions 100*a* and 100*b* of the gap maintaining member 100A have portions 100*d* and 100*e*, which come into contact, and remain in contact, with the right and left slide frame 30 and 31, respectively. These portions 100*d* and 100*e* are in the form of a recess (or bulge), the depth (or height) direction of which is roughly perpendicular to the direction (indicated by arrow mark M) in which the gap maintaining member 100A is engaged into the process cartridge B, and the direction (indicated by arrow mark N) in which the 100A is disengaged from the process cartridge B. Thus, the portion of the right slide frame 30, which engages with the portion 100*d* of the gap maintaining portion 100*a* of the gap maintaining member 100, and the portion of the left slide frame 31, which engages with the portion 100*e* of the gap maintaining portion 100*b* of the gap maintaining member 100, are in the form of a bulge (or recess). Although FIG. 11 does not show the left slide frame 31, the left slide frame 31 is the same in structure as the right slide frame 30.

In the first embodiment of the present invention, the force which is generated by the resiliency of the springs 28*a* and 28*b* and presses on the gap maintaining portions 100*a* and 100*b* of the gap maintaining member 100 through the developing means container unit 15, was used to prevent the gap maintaining member 100 from unexpectedly moving in the direction in which the gap maintaining member 100 is to be engaged into, or disengaged from, the process cartridge B. Further, the weight of the developing means container unit 15 itself is utilized to prevent the gap maintaining member 100 from unexpectedly moving in the direction in which the gap maintaining member 100 is to be engaged into, or disengaged from, the process cartridge B, by keeping the gap maintaining portion 100*a* sandwiched between the contact surface 12*a* of the waste toner container 12, and the right slide frame 30, and keeping the gap maintaining portion 100*b* sandwiched between the contact surface 12*b* of the waste toner container 12, and the right slide frame 30.

However, this setup suffers from the following problem if the amount of the friction generated between the gap maintaining member 100 and the process cartridge B by the force which is generated by the resiliency of the springs 28*a* and 28*b* and presses on the gap maintaining member 100 through the developing means container unit 15, and the force which is generated by the weight of the developing means container unit 15 and pressed on the gap maintaining member 100, is smaller than the amount of the force generated by the impact to which the process cartridge B is subjected during the distribution of the process cartridge B.

That is, it is possible that the moment the process cartridge B is impacted during its distribution, the gap maintaining member 100 will be moved in the direction in which it is to be disengaged (direction indicated by arrow N), and will not return to the original position.

In this embodiment, therefore, the gap maintaining portions 100*a* and 100*b* of the gap maintaining member 100A are provided with portions 100*d* and 100*e*, which are in the form of a recess (or bulge), the depth (or height) direction of which is roughly perpendicular to the direction (indicated by arrow mark M) in which the gap maintaining member 100A is engaged into the process cartridge B, and the direction (indicated by arrow mark N) in which the 100A is disengaged from the process cartridge B. The provision of these recesses (bulges) increases in size the area of contact between the gap maintaining member 100A and the right slide frame 30, and the area of contact between the gap maintaining member 100A and the left slide frame 31, increasing thereby the amount of friction between the gap maintaining member 100A and right slide frame 30, and the amount of friction between the gap maintaining member 100A and left slide frame 31. In other words, the employment of the structural arrangement, in this embodiment, for the process cartridge B and gap maintaining member 100A makes it possible to increase the amount of force necessary to move the gap maintaining member 100A, making thereby the process cartridge B and gap maintaining member 100A more resistant to the external impact, in terms of the amount of impact. Therefore, the combination of the process cartridge B and gap maintaining member 100A in this embodiment is superior to the combination of the process cartridge B and gap maintaining member 100 in the first embodiment, in terms of the prevention of the disengagement of a gap maintaining member from a process cartridge.

Incidentally, the impact to which the process cartridge B is subjected during the distribution of the process cartridge B may sometimes exceed in magnitude even the abovementioned increased friction, that is, may be large enough to displace the gap maintaining member 100A. However, as long as the amount of the displacement is slight, the force generated by the resiliency of the springs 28*a* and 28*b*, and the weight of the developing means container unit 15, function to move the gap maintaining member 100A back to where it was. Therefore, the combination of the process cartridge B and gap maintaining member in this embodiment is far superior to the combination of the process cartridge B and gap maintaining member in the first embodiment, in terms of the prevention of the disengagement of a gap maintaining member from a process cartridge in the direction in which the process cartridge is to be disengaged (direction indicated by arrow mark N).

The present invention relates to a process cartridge, which is made up of a photosensitive member unit, a toner storage unit solidly attached to the photosensitive member unit, and a developer bearing member supporting frame movable relative to the toner storage unit, and which is characterized in that it can significantly reduce the effect which the weight of the developer storage portion has upon the portion of the peripheral surface of the electrophotographic photosensitive member, which is in contact with the developer bearing member, when a process cartridge is subjected impact during its distribution. More specifically, according to the present invention, a combination of a process cartridge and a gap maintaining member is structured so that after the completion of the process cartridge, the process cartridge is fitted with the gap maintaining member to displace the developer bearing member supporting frame against the force generated by a pair of pressure generating members, in order to keep the distance between the rotational axis of the electrophotographic photosensitive member and the rotational axis of the developer bearing member greater during the distribution of the process cartridge than when the process cartridge is being used for image formation, or to keep the electrophotographic photosensitive member separated from a pair of gap regulating members, with which the lengthwise end portions of the developer bearing member are fitted, one for one, during the distribution of the process cartridge.

Thus, the present invention makes it possible to reduce the distance by which a developer bearing member needs to be moved to increase the distance between an electrophotographic photosensitive member and the developer bearing member for the distribution of a process cartridge, compared to the distance which is kept between the electrophotographic photosensitive and developer bearing member when the process cartridge is being used for image formation, or to reduce the distance which needs to be kept between an electrophotographic photosensitive member and a pair of gap regulating members with which the lengthwise end portions of the developer bearing member are fitted, for the distribution of a process cartridge. Therefore, the present invention can make it possible to reduce in size the gap maintaining member for preventing an electrophotographic photosensitive member, a developer bearing member, and/or a gap regulating member from being damaged (deformed) during the distribution of a process cartridge, even for a process cartridge of a large size. Further, according to the present invention, the force to which the gap maintaining member is subjected is only the force generated by the resiliency of the pressure generating members, and the weight of the movable frame. Therefore, the employment of the present invention can make it possible to reduce the amount of force necessary to disengage the gap maintaining member from a process cartridge.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 105689/2007 filed Apr. 13, 2007, which is hereby incorporated by reference.

What is claimed is:

1. A process cartridge detachably mountable to a main assembly of an electrophotographic image forming apparatus, said process cartridge comprising:

a photosensitive member unit having a photosensitive drum;

a developer carrying member for developing an electrostatic latent image formed on said photosensitive drum with a developer;

a toner accommodating unit having a developer accommodating portion accommodating the developer to be used for development of said electrostatic latent image, said toner accommodating unit being fixed to said photosensitive member unit;

a movable frame that is movable relative to said toner accommodating unit and supports said developer carrying member;

an urging member for urging said movable frame in a direction in which said developer carrying member approaches said photosensitive drum; and a space maintaining member, demountably provided between said photosensitive member unit and said movable frame in contact to said photosensitive member unit and said movable frame, for maintaining a state in which a distance between said photosensitive drum and said developer carrying member is larger than that in an image formation, wherein said developer carrying member includes a gap maintaining member, provided at each of one and the other longitudinal ends of said developer carrying member in contact to said photosensitive drum, to provide a predetermined gap between said photosensitive drum and said developer carrying member, and wherein said space maintaining member spaces said photosensitive drum and said gap maintaining member from each other.

2. A process cartridge according to claim 1, further comprising a first side cover connecting said photosensitive member unit and said toner accommodating unit at longitudinal ends of said photosensitive member unit and said toner accommodating unit, and a second side cover connecting said photosensitive member unit and said toner accommodating unit with each other at the other longitudinal ends of said photosensitive member unit and said toner accommodating unit, wherein said first side cover and said second side cover are provided with guides for guiding mounting and demounting of said space maintaining member.

3. A process cartridge according to claim 1, further comprising an exposure opening for permitting passage of light to which said photosensitive drum is exposed.

4. A process cartridge according to claim 1, further comprising a grip portion to be gripped by a user when said space maintaining member is dismounted from said process cartridge.

5. A process cartridge according to claim 1, wherein said space maintaining member includes a recess for engagement with a projection provided in said movable frame to prevent said space maintaining member from disengaging from said process cartridge.

6. A process cartridge according to claim 1, said movable frame supports a developing blade for regulating a layer thickness of the developer carried on said developer carrying member.

* * * * *